US012071950B2

(12) United States Patent
Hagita et al.

(10) Patent No.: US 12,071,950 B2
(45) Date of Patent: Aug. 27, 2024

(54) ELECTRIC COMPRESSOR

(71) Applicant: MITSUBISHI HEAVY INDUSTRIES THERMAL SYSTEMS, LTD., Tokyo (JP)

(72) Inventors: Takayuki Hagita, Tokyo (JP); Akinori Yoshioka, Tokyo (JP); Manabu Suzuki, Tokyo (JP); Hideo Saho, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 232 days.

(21) Appl. No.: 17/767,001

(22) PCT Filed: Oct. 11, 2019

(86) PCT No.: PCT/JP2019/040222
§ 371 (c)(1),
(2) Date: Apr. 6, 2022

(87) PCT Pub. No.: WO2021/070357
PCT Pub. Date: Apr. 15, 2021

(65) Prior Publication Data

US 2022/0372980 A1 Nov. 24, 2022

(51) Int. Cl.
*F04C 18/02* (2006.01)
*F04C 23/02* (2006.01)

(52) U.S. Cl.
CPC ..... *F04C 23/02* (2013.01); *F04C 18/0215* (2013.01); *F04C 2240/30* (2013.01); *F04C 2240/40* (2013.01); *F04C 2240/808* (2013.01)

(58) Field of Classification Search
CPC ..... F04C 18/02; F04C 18/0215; F04C 29/06; F01C 1/0215; F04B 11/00
See application file for complete search history.

(56) References Cited

U.S. PATENT DOCUMENTS 10,292,281 B2 5/2019 Saito et al.
2008/0141693 A1 6/2008 Enami et al.
(Continued)

FOREIGN PATENT DOCUMENTS

EP 2 918 841 A1 9/2015
JP 8-316662 A 11/1996
(Continued)

OTHER PUBLICATIONS

International Search Report for International Application No. PCT/JP2019/040222, dated Dec. 24, 2019, with English translation.
(Continued)

*Primary Examiner* — Philip E Stimpert
*Assistant Examiner* — Dnyanesh G Kasture
(74) *Attorney, Agent, or Firm* — BIRCH, STEWART, KOLASCH & BIRCH, LLP

(57) ABSTRACT

This electric compressor (10) has: an accommodating case (15) that accommodates an inverter device (19) and includes an accommodating section body (31), a substrate support section (32) protruding from a bottom surface (31*a*) of the accommodating section body (31), and a cover member (34) that closes an opening in the accommodating section body (31); and an antivibration member (17) that is positioned between one surface (51*a*) of a head part (51) of a bolt (16) fastened to the substrate support section (32) and an inner surface (34*a*) of the cover member (34), and that is bonded to the one surface (51*a*) of the head part (51) and the inner surface (34*a*) of the cover member (34).

16 Claims, 12 Drawing Sheets

(56) References Cited

U.S. PATENT DOCUMENTS

| | | | |
|---|---|---|---|
| 2013/0048102 | A1 | 2/2013 | Hagita et al. |
| 2018/0180061 | A1 | 6/2018 | Kinoshita et al. |
| 2018/0374467 | A1* | 12/2018 | Tomiyama ..... B60R 13/0838 |

FOREIGN PATENT DOCUMENTS

| | | | |
|---|---|---|---|
| JP | 2008-133729 | A | 6/2008 |
| JP | 2008-157443 | A | 7/2008 |
| JP | 2012-117444 | A | 6/2012 |
| JP | 2012-117445 | A | 6/2012 |
| JP | 2013-177828 | A | 9/2013 |
| JP | 2013-194538 | A | 9/2013 |
| JP | 2014-120677 | A | 6/2014 |
| JP | 5653695 | B2 | 1/2015 |
| JP | 2016-118183 | A | 6/2016 |
| JP | 2018-512734 | A | 5/2018 |
| JP | 2018-105281 | A | 7/2018 |
| WO | WO 2014/080553 | A1 | 5/2014 |
| WO | WO 2016/150892 | A1 | 9/2016 |

OTHER PUBLICATIONS

Written Opinion of the International Searching Authority for International Application No. PCT/JP2019/040222, dated Dec. 24, 2019, with English translation.

* cited by examiner

ELECTRIC COMPRESSOR

TECHNICAL FIELD

The present invention relates to an electric compressor.

BACKGROUND ART

In the related art, as a compressor for an air conditioner mounted in vehicles such as electric vehicles or hybrid vehicles, an electric compressor in which an inverter device is integrally built-in has been used.

The electric compressor having such a configuration includes an accommodation casing (inverter box) made of metal that is disposed at an outer periphery of a housing in which an electric motor and a compressor (for example, a scroll compressor) are built-in.

The inverter device that converts DC power supplied from a high-voltage power supply unit, into three-phase AC power to supply the three-way AC power to the electric motor is built-in inside the accommodation casing.

The accommodation casing includes an accommodation portion body having an opening into which the inverter device is inserted, and a cover member that is fixed to close the opening of the accommodation portion body.

The cover member is fixed to the accommodation portion body with bolts or the like to close the opening of the accommodation portion body.

Since a part of the accommodation portion body is in direct contact with or in contact with the cover member via fastening bolts, the accommodation portion body and the cover member are in metal contact with each other.

In the case of such a structure where the accommodation portion body and the cover member are in metal contact with each other, when vibration is generated by the compressor or the like, the vibration is transmitted to the cover member via the accommodation portion body, and the cover member vibrates and generates noise, which is a problem.

As a technique intended to solve such a problem, there is an electric compressor disclosed in PTL 1.

PTL 1 discloses an electric compressor including an accommodation portion body which has an opening and inside which an inverter device is accommodated and installed; a cover member that covers the opening; and a gasket that is interposed between the accommodation portion body and the cover member to seal a gap between the accommodation portion body and the cover member. The gasket includes a flat metal core material and a foamed elastic body provided to cover both surfaces of the core material, and has concavities and convexities of a predetermined shape provided by embossing. The accommodation portion body and the cover member are fastened with bolts, and the concavities and convexities imparted to the gasket are disposed to be closer to an inside of the accommodation portion body than the bolts.

CITATION LIST

Patent Literature

[PTL 1] Japanese Patent No. 5653695

SUMMARY OF INVENTION

Technical Problem

However, in the electric compressor disclosed in PTL 1, since the accommodation portion body and the cover member are configured to be fastened with the bolts via the gasket, when the cover member is displaced in a direction away from the accommodation portion body and the gasket is separated from the gasket or the accommodation portion body, it is difficult for the gasket to isolate vibration of the cover member, and noise caused by vibration of the cover member cannot be reduced, which is a concern.

Therefore, an object of the present invention is to provide an electric compressor capable of reducing noise caused by vibration of a cover member.

Solution to Problem

In order to solve the above problem, according to a first aspect of the present invention, there is provided an electric compressor including: a housing that accommodates a compressor and an electric motor that drives the compressor; an inverter device including a circuit substrate on which an electronic component is mounted; an accommodation casing including an accommodation portion body provided on a side surface of the housing to accommodate the inverter device, a substrate support portion that protrudes to an inside of the accommodation portion body to support one surface of the circuit substrate, and a cover member fixed to the accommodation portion body to close an opening of the accommodation portion body; a bolt which is fastened to the substrate support portion to restrict a position of the circuit substrate with respect to the substrate support portion, and in which one surface of a head facing an inner surface of the cover member is flat; and a first vibration isolation member that is disposed between the one surface of the head and the inner surface of the cover member and that is bonded to the one surface of the head and to the inner surface of the cover member.

According to the present invention, since the first vibration isolation member is provided that is disposed between the one surface (flat surface) of the head of the bolt and the inner surface of the cover member and that is bonded to the one surface of the head and to the inner surface of the cover member, when the cover member is displaced in a direction away from the head of the bolt, a state where the first vibration isolation member is connected to the head and to the cover member can be maintained.

Accordingly, the state where the first vibration isolation member is connected to the head and to the cover member can be maintained without depending on displacement directions of the cover member (in this case, a direction where the cover member is separated from the head of the bolt and a direction where the cover member approaches the head of the bolt). Accordingly, when the cover member vibrates, the vibration of the cover member can be suppressed by the first vibration isolation member, so that noise caused by the vibration of the cover member can be reduced.

In the electric compressor according to the first aspect of the present invention, the head may be provided with a screw hole, and a gasket disposed on an outer surface of the cover member, and a screw screwed into the screw hole via the gasket may be provided.

According to the present invention, since the gasket having a vibration isolation function that is disposed on the outer surface of the cover member, and the screw that is screwed into the screw hole provided in the head via the gasket are provided, when the cover member is displaced in the direction away from the head of the bolt, the state where the first vibration isolation member is connected to the head and to the cover member can be maintained without bonding the first vibration isolation member to the one surface of the head and to the inner surface of the cover member.

Accordingly, the state where the first vibration isolation member is connected to the head and to the cover member can be maintained without depending on displacement directions of the cover member (in this case, a direction where the cover member is separated from the head of the bolt and a direction where the cover member approaches the head of the bolt). Therefore, when the cover member vibrates, the vibration of the cover member can be suppressed by the first vibration isolation member, so that noise caused by the vibration of the cover member can be reduced.

In the electric compressor according to the first aspect of the present invention, the gasket may be made of rubber.

In such a manner, when the gasket made of rubber is used, vibration of the cover member can be suppressed by using the first vibration isolation member and the gasket, so that the effect of reducing noise caused by the vibration of the cover member can be further enhanced.

In the electric compressor according to the first aspect of the present invention, the gasket may have a surging frequency equal to or higher than a frequency of a primary eigenvalue of the cover member.

In such a manner, since the gasket is used that has a surging frequency equal to or higher than the frequency of the primary eigenvalue of the cover member, the effect of reducing noise caused by vibration of the cover member can be enhanced.

In the electric compressor according to the first aspect of the present invention, the head may be provided with a screw hole, and a screw may be provided that penetrates through the cover member and through the first vibration isolation member from outside the cover member to be screwed into the screw hole.

In such a manner, since the screw is provided that penetrates through the cover member and through the first vibration isolation member from outside the cover member to be screwed into the screw hole provided in the head of the bolt, the displacement of the cover member in the direction away from the head of the bolt can be restricted, and the strength of connection between the inner surface of the cover member and the first vibration isolation member can be increased.

Accordingly, the effect of suppressing vibration of the cover member can be enhanced, so that the effect of reducing noise caused by the vibration of the cover member can be enhanced.

According to a second aspect of the present invention, there is provided an electric compressor including: a housing that accommodates a compressor and an electric motor that drives the compressor; an inverter device including a circuit substrate on which an electronic component is mounted; an accommodation casing including an accommodation portion body provided on a side surface of the housing to accommodate the inverter device, a substrate support portion that protrudes to an inside of the accommodation portion body to support one surface of the circuit substrate, and a cover member fixed to the accommodation portion body to close an opening of the accommodation portion body; a bolt which is fastened to the substrate support portion to restrict a position of the circuit substrate with respect to the substrate support portion, and in which one surface of a head facing an inner surface of the cover member is flat; and a second vibration isolation member that is disposed between the one surface of the head and the inner surface of the cover member and that has a surging frequency equal to or higher than a frequency of a primary eigenvalue of the cover member.

In such a manner, since the second vibration isolation member is provided that is disposed between the one surface of the head of the bolt and the inner surface of the cover member and that has a surging frequency equal to or higher than the frequency of the primary eigenvalue of the cover member, noise caused by vibration of the cover member can be reduced without bonding the second vibration isolation member to the one surface of the head of the bolt and to the inner surface of the cover member.

In the electric compressor according to the second aspect of the present invention, the head may be provided with a screw hole, and a screw may be provided that penetrates through the cover member and through the second vibration isolation member from outside the cover member to be screwed into the screw hole.

In such a manner, since the screw is provided that penetrates through the cover member and through the second vibration isolation member from outside the cover member to be screwed into the screw hole provided in the head of the bolt, the displacement of the cover member in the direction away from the head of the bolt can be restricted, and the strength of connection between the inner surface of the cover member and the second vibration isolation member can be increased.

Accordingly, the effect of suppressing vibration of the cover member can be enhanced, so that the effect of reducing noise caused by the vibration of the cover member can be enhanced.

The electric compressor according to the second aspect of the present invention may further include a gasket disposed on an outer surface of the cover member, and the screw may be screwed into the screw hole via the gasket.

In such a manner, since the gasket disposed on the outer surface of the cover member is provided and the screw is screwed into the screw hole via the gasket, when the gasket is made of metal, the loosening of the screw can be prevented.

In the electric compressor according to the second aspect of the present invention, the gasket may be made of rubber.

In such a manner, when the gasket made of rubber is used, vibration of the cover member can be suppressed by using the second vibration isolation member and the gasket, so that the effect of reducing noise caused by the vibration of the cover member can be further enhanced.

According to a third aspect of the present invention, there is provided an electric compressor including: a housing that accommodates a compressor and an electric motor that drives the compressor; an inverter device including a circuit substrate on which an electronic component is mounted; and an accommodation casing including an accommodation portion body provided on a side surface of the housing to accommodate the inverter device, a substrate support portion that protrudes to an inside of the accommodation portion body to support one surface of the circuit substrate, and a cover member fixed to the accommodation portion body to close an opening of the accommodation portion body. The cover member includes a through-hole at a portion facing the substrate support portion. A grommet having a vibration isolation property that includes a ring-shaped groove accommodating the cover member located around the through-hole and that is mounted in the through-hole, and a screw that penetrates through the grommet from outside the cover member to be screwed to the substrate support portion are provided.

According to the present invention, since the grommet having a vibration isolation property that includes the ring-shaped groove accommodating the cover member located around the through-hole provided in the cover member and that is mounted in the through-hole, and the screw that penetrates through the grommet from outside the cover member to be screwed to the substrate support portion are provided, when the cover member is displaced in the direction away from the head of the bolt, a state where the grommet is connected to the other surface of the circuit substrate and to the cover member can be maintained. Therefore, noise caused by vibration of the cover member can be reduced.

In addition, since a part of the grommet is disposed not only between the circuit substrate and the cover member but also on an outer side of the cover member, the effect of reducing noise caused by vibration of the cover member can be further enhanced.

In the electric compressor according to the third aspect of the present invention, the grommet may be bonded to the other surface of the circuit substrate and to the cover member.

According to the present invention, since the grommet is bonded to the other surface of the circuit substrate and to the cover member, when the cover member is displaced in the direction away from the circuit substrate, the state where the grommet is connected to the other surface of the circuit substrate and to the cover member can be maintained.

Accordingly, vibration of the cover member can be suppressed by the grommet, so that noise caused by the vibration of the cover member can be reduced.

In addition, since a part of the grommet is disposed not only between the circuit substrate and the cover member but also on the outer side of the cover member, the effect of reducing noise caused by vibration of the cover member can be further enhanced.

In the electric compressor according to the third aspect of the present invention, the grommet may have a surging frequency equal to or higher than a frequency of a primary eigenvalue of the cover member.

In such a manner, since the grommet is used that has a surging frequency equal to or higher than the frequency of the primary eigenvalue of the cover member, the effect of reducing noise caused by vibration of the cover member can be enhanced without bonding the grommet to the circuit substrate and to the cover member.

In the electric compressor according to the first to third aspects of the present invention, the compressor may include a fixed scroll and a movable scroll each having a spiral shape, a plurality of compression chambers that are formed between the fixed scroll and the movable scroll to compress a refrigerant by means of a movement of the movable scroll, and a discharge port that discharges the compressed refrigerant. When an average value of a length $S_1$ (mm) of an inner curved line of the fixed scroll in a stage where the compressor discharges the refrigerant from the discharge port, the fixed scroll partitioning a compression chamber formed on an innermost side among the plurality of compression chambers, and of a length $S_2$ (mm) of an outer curved line of the movable scroll that partitions the compression chamber formed on the innermost side is an average value $S_{AV}$ (mm), an eigenvalue E (kHz) of the cover member may satisfy the following equation (1):

$$E \geq V/S_{AV} \quad (1)$$

here, in the equation (1), V (m/s) is a sound speed of the refrigerant.

In such a manner, since the eigenvalue E of the cover member is set to satisfy the equation (1), when vibration of the compressor is transmitted to the accommodation portion body, the vibration of the cover member can be suppressed by the first or second vibration isolation member. Accordingly, noise caused by the vibration of the cover member can be reduced.

According to a fourth aspect of the present invention, there is provided an electric compressor including: a housing that accommodates a compressor and an electric motor that drives the compressor; an inverter device including a circuit substrate on which an electronic component is mounted; an accommodation casing including an accommodation portion body provided on a side surface of the housing to accommodate the inverter device, a substrate support portion that protrudes to an inside of the accommodation portion body to support one surface of the circuit substrate, and a cover member fixed to the accommodation portion body to close an opening of the accommodation portion body; and a third vibration isolation member that is in contact with an inner surface of the cover member. The compressor includes a fixed scroll and a movable scroll each having a spiral shape, a plurality of compression chambers that are formed between the fixed scroll and the movable scroll to compress a refrigerant by means of a movement of the movable scroll, and a discharge port that discharges the compressed refrigerant. When an average value of a length $S_1$ (mm) of an inner curved line of the fixed scroll in a stage where the compressor discharges the refrigerant from the discharge port, the fixed scroll partitioning a compression chamber formed on an innermost side among the plurality of compression chambers, and of a length $S_2$ (mm) of an outer curved line of the movable scroll that partitions the compression chamber formed on the innermost side is an average value $S_{AV}$ (mm), an eigenvalue E (kHz) of the cover member satisfies the following equation (2):

$$E \geq V/S_{AV} \quad (2)$$

here, in the equation (2), V (m/s) is a sound speed of the refrigerant.

Fluid sound in a cylinder of the scroll compressor is generated by a relationship between a representative length of the compression chambers and the sound speed. The representative length is a length equivalent to a length of an innermost circumference of the scroll compression chamber. Therefore, the eigenvalue E (kHz) of the cover member may be equal to or more than an eigenvalue of the fluid sound in the cylinder.

Since the eigenvalue of the cover member is set to satisfy the equation (2), with the simple configuration, vibration of the cover member can be suppressed by using the third vibration isolation member. Accordingly, noise caused by the vibration of the cover member can be reduced.

The inner curved line of the fixed scroll may be referred to as a ventral side curved line. In addition, the outer curved line of the movable scroll may be referred to as a dorsal side curved line.

Advantageous Effects of Invention

According to the present invention, noise caused by vibration of the cover member can be reduced.

DESCRIPTION OF EMBODIMENTS

Hereinafter, embodiments to which the present invention is applied will be described in detail with reference to the drawings. The drawings to be used in the following description are for describing configurations of the embodiments of the present invention, and the size, thickness, dimension and the like of each portion illustrated may be different from a dimensional relationship of an actual electric compressor.

First Embodiment

Figure 1:
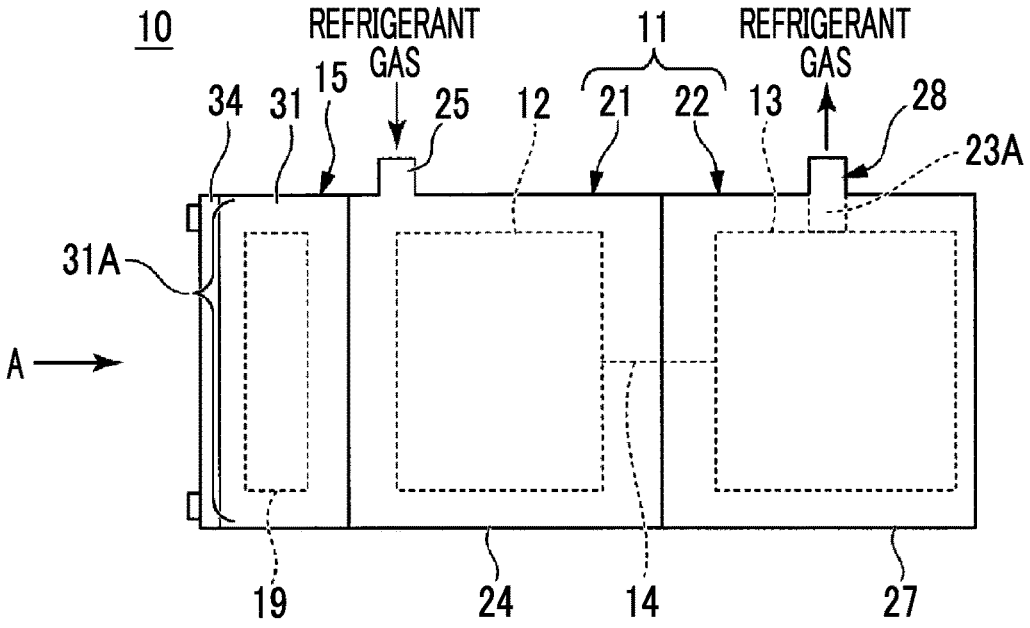
FIG. 1 is a side view illustrating a schematic configuration of an electric compressor according to a first embodiment of the present invention.

FIG. 1 is a side view illustrating a schematic configuration of an electric compressor according to a first embodiment of the present invention. FIG. 1 illustrates an inverter-integrated electric compressor to be used in a vehicle air conditioner, as one example of an electric compressor 10.

Figure 2:
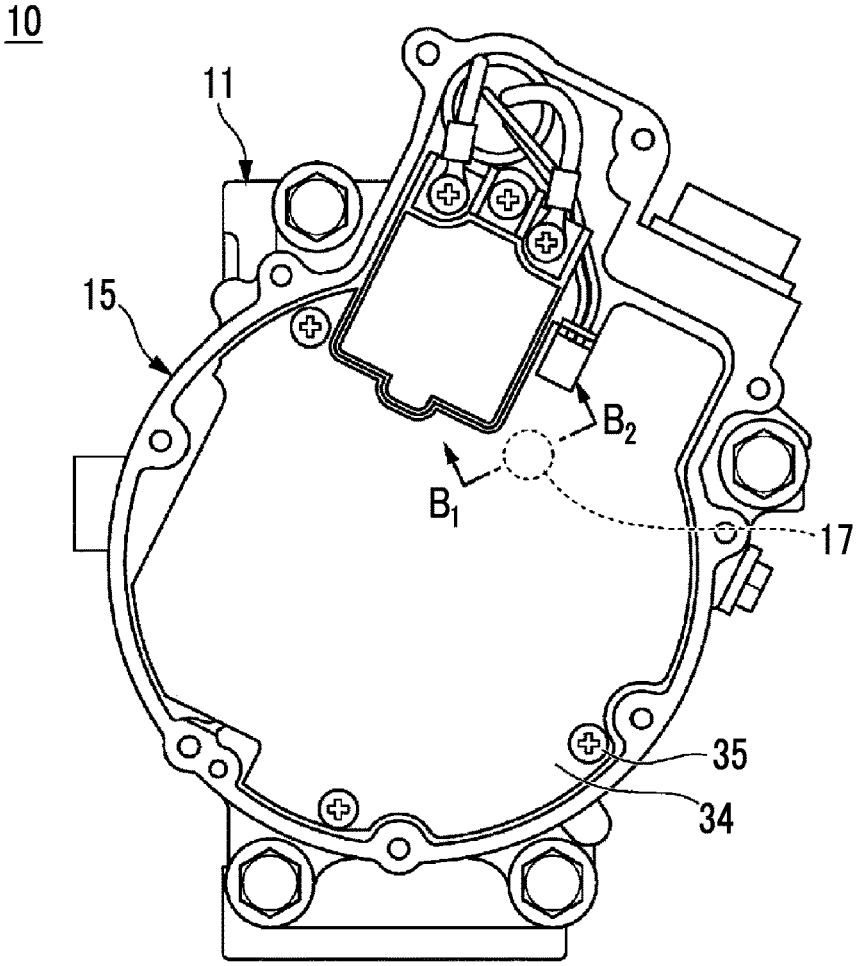
FIG. 2 is a side view of the electric compressor illustrated in FIG. 1 as viewed from A.

FIG. 2 is a side view of the electric compressor illustrated in FIG. 1 as viewed from A. In FIG. 2, the same components as those of the structure illustrated in FIG. 1 are denoted by the same reference signs.

Figure 3:
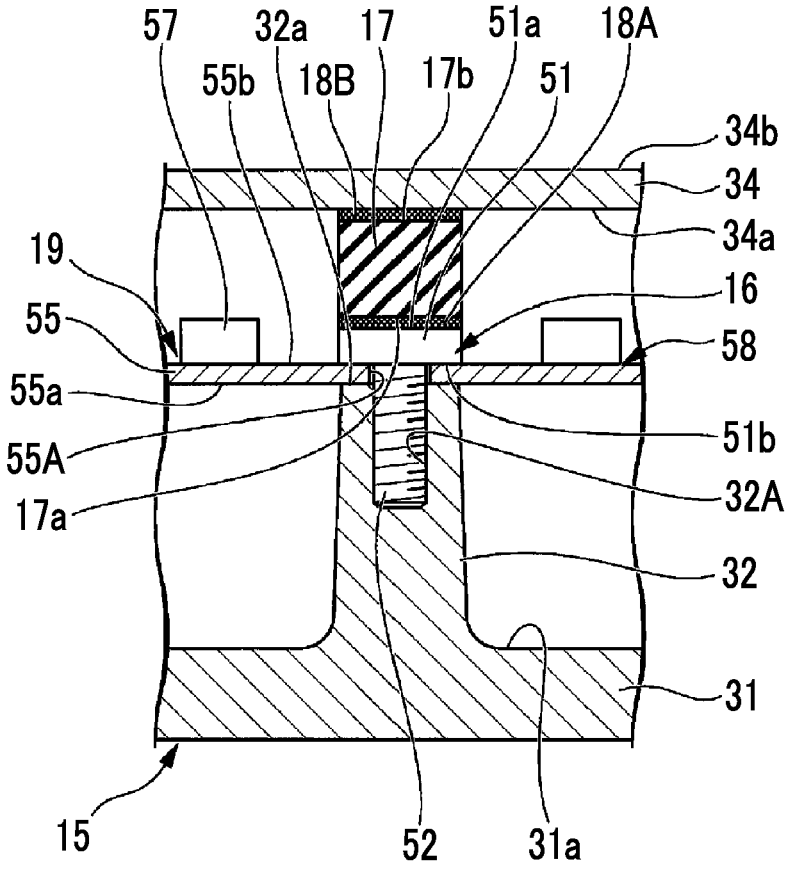
FIG. 3 is a cross-sectional view of an accommodation casing illustrated in FIG. 2 that accommodates an inverter device illustrated in FIG. 1, taken along line $B_1$-$B_2$.

FIG. 3 is a cross-sectional view of an accommodation casing illustrated in FIG. 2 that accommodates an inverter device illustrated in FIG. 1, taken along line $B_1$-$B_2$. In FIG. 3, the same components as those of the structure illustrated in FIGS. 1 and 2 are denoted by the same reference signs.

Referring to FIGS. 1 to 3, the electric compressor of the first embodiment includes a housing 11, an electric motor 12, a compressor 13, a motor shaft 14, an accommodation casing 15, a bolt 16, a vibration isolation member 17, a first adhesive layer 18A, a second adhesive layer 18B, and an inverter device 19.

The housing 11 includes a first housing portion 21 and a second housing portion 22. The first housing portion 21 includes a housing main body 24 that accommodates the electric motor 12, and a refrigerant suction port 25 provided in the housing main body 24.

The refrigerant suction port 25 introduces the refrigerant gas (refrigerant) of low temperature and low pressure into the housing main body 24 from outside the housing 11. The refrigerant gas of low temperature and low pressure introduced into the housing main body 24 flows around the electric motor 12, flows into the second housing portion 22, and then is suctioned into and compressed by the compressor 13.

The second housing portion 22 includes a housing main body 27 that accommodates the compressor 13, and a discharge portion 28 that is provided in the housing main body 27 to discharge the refrigerant gas. The housing main body 27 is fastened and fixed to the housing main body 24 using a plurality of bolts (not illustrated). Accordingly, the first housing portion 21 and the second housing portion 22 are integrally configured.

The housing 11 is configured such that the refrigerant in the first housing portion 21 is movable into the second housing portion 22. The discharge portion 28 includes a discharge port 28A that extends to a central portion of the compressor 13 to discharge the compressed refrigerant gas. The discharge port 28A forms a part of the compressor 13.

The discharge portion 28 having the above configuration discharges the refrigerant of high temperature and high pressure compressed and generated by the compressor 13, to the outside of the housing 11.

The housing 11 having the above configuration functions as a pressure resistant container. For example, die cast aluminum can be used as a material of the housing 11.

The electric motor 12 is connected to one end of the motor shaft 14. The electric motor 12 drives the compressor 13 via the motor shaft 14.

Figure 4:
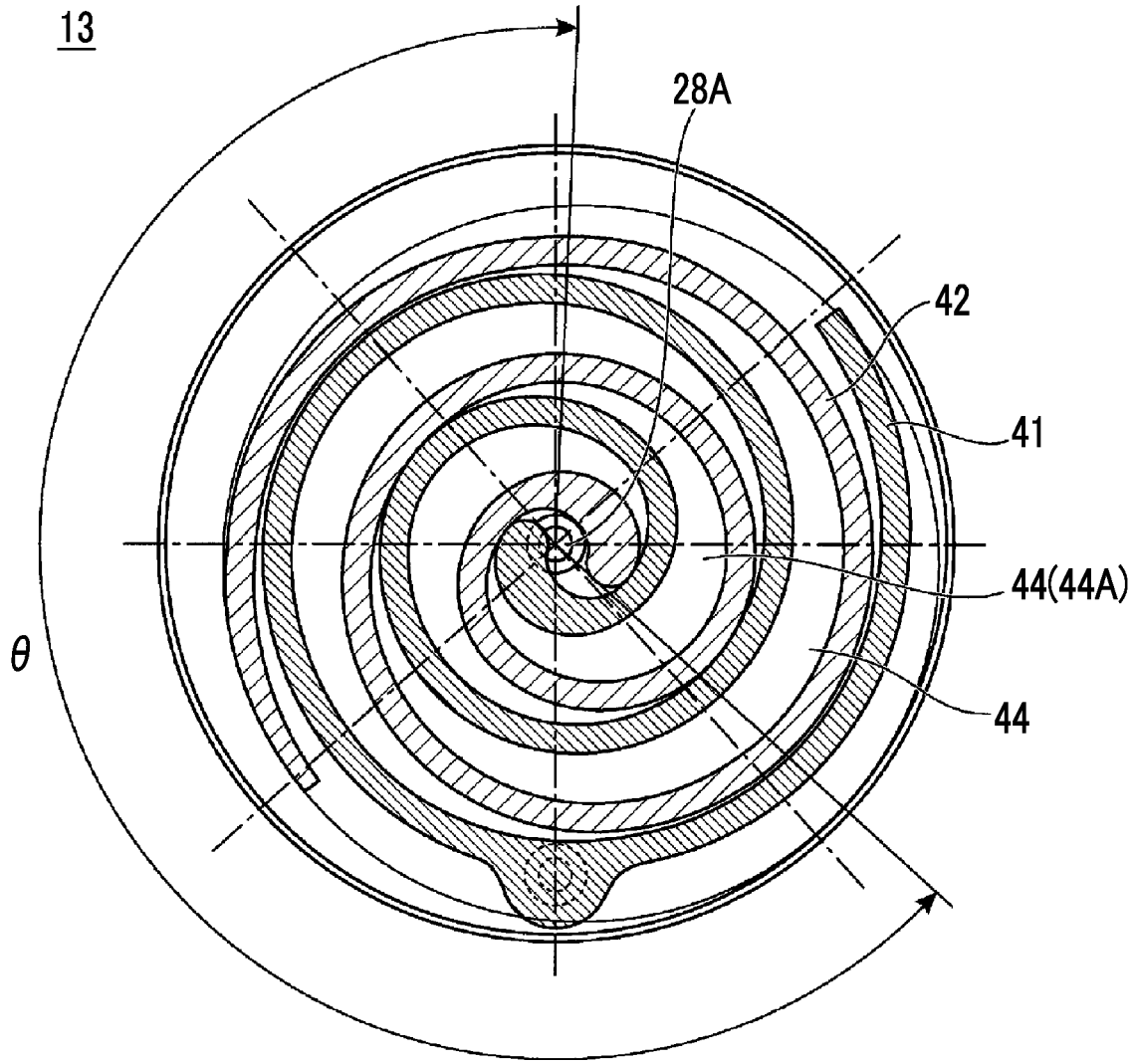
FIG. 4 is a cross-sectional view illustrating an internal structure of a compressor illustrated in FIG. 1.

FIG. 4 is a cross-sectional view illustrating an internal structure of the compressor illustrated in FIG. 1. FIG. 4 illustrates a scroll compressor as one example of the compressor 13. The compressor 13 illustrated in FIG. 4 schematically illustrates a state where the refrigerant gas of high temperature and high pressure is discharged from the discharge port 28A.

In addition, FIG. 4 illustrates a state where a position angle θ of a movable scroll 42 with respect to the position of a fixed scroll 41 is 230°. The position angle θ is an angle indicating the position of the movable scroll 42 with respect to a back side winding end of the fixed scroll 41.

Further, FIG. 4 illustrates a compression chamber that is formed at a position closest to the discharge port 28A among a plurality of compression chambers 44 in a refrigerant gas discharge stage, as a compression chamber 44A. In FIG. 4, the same components as those of the structure illustrated in FIGS. 1 to 3 are denoted by the same reference signs.

Referring to FIGS. 1 and 4, the compressor 13 is a scroll compressor and is connected to the other end of the motor shaft 14.

The compressor 13 includes the fixed scroll 41 having a spiral shape; the movable scroll 42 each having a spiral shape; the plurality of compression chambers 44 that are formed between the fixed scroll 41 and the movable scroll 42 to compress the refrigerant gas by means of movement of the movable scroll 42 (including the compression chamber 44A); and the discharge port 28A that faces a central portion of the fixed scroll 41 to discharge the compressed refrigerant gas.

The compressor 13 compresses the refrigerant gas of low temperature and low pressure in a direction toward a center of the compressor 13 using the plurality of compression chambers 44 that are changed in shape by movement of the movable scroll 42, thereby generating the refrigerant gas of high temperature and high pressure.

Then, the refrigerant gas of high temperature and high pressure is guided to the discharge port 28A disposed at the center of the compressor 13 (center of the fixed scroll 41), and is supplied to the outside of the electric compressor 10 via the discharge port 28A.

The accommodation casing 15 is a metal casing, and includes an accommodation portion body 31, a substrate support portion 32, a cover member 34, and a plurality of screws 35.

The accommodation portion body 31 is provided on a side surface of the first housing portion 21 (side surface of the housing 11). The accommodation portion body 31 has an opening 31A. The accommodation portion body 31 accommodates the inverter device 19.

The substrate support portion 32 is provided on a bottom surface 31*a* of the accommodation portion body 31. The substrate support portion 32 protrudes in a direction orthogonal to the bottom surface 31*a* of the accommodation portion body 31. Namely, the substrate support portion 32 protrudes to an inside of the accommodation portion body 31. A tip surface 32*a* of the substrate support portion 32 is a flat surface. The tip surface 32*a* of the substrate support portion 32 supports one surface 55*a* of a circuit substrate 55 to be described later that forms the inverter device 19.

The substrate support portion 32 has a screw hole 32A to which the bolt 16 is fastened. The screw hole 32A is exposed from the tip surface 32*a*, and extends in the direction orthogonal to the bottom surface 31*a*.

The cover member 34 is a plate-shaped member, and is disposed on the accommodation portion body 31 to close the opening 31A. The cover member 34 has an inner surface 34*a* disposed on an accommodation portion body 31 side, and an outer surface 34*b* disposed on a side opposite the inner surface 34*a*. In addition, the cover member 34 has a plurality of screw holes (not illustrated) in an outer peripheral portion of the cover member 34.

Shanks of the plurality of screws 35 are screwed into the screw holes formed in the cover member 34 and to an edge portion of the accommodation portion body 31 that faces the screw holes of the cover member 34. Accordingly, the cover member 34 is fixed to the accommodation portion body 31.

Referring to FIG. 3, the bolt 16 includes a head 51 and a shank 52 that is male threaded. The head 51 has one surface 51*a* and the other surface 51*b* on which the shank 52 is provided. The one surface 51*a* is a flat surface and has a circular shape. The other surface 51*b* is a flat surface disposed on a side opposite the one surface 51*a*.

The shank 52 of the bolt 16 is fastened to the screw hole 32A provided in the substrate support portion 32 in a state where the shank 52 is inserted into a through-hole 55A formed in the circuit substrate 55. Accordingly, the circuit substrate 55 is fixed to the substrate support portion 32 with the bolt 16.

The vibration isolation member 17 is provided between the one surface 51*a* of the head 51 and the inner surface 34*a* of the cover member 34. The vibration isolation member 17 is a member that suppresses vibration of the cover member 34 when vibration generated from the compressor 13 is transmitted to the cover member 34. For example, a vibration isolation rubber (vibration isolation member made of rubber) can be used as the vibration isolation member 17.

When a vibration isolation rubber is used as the vibration isolation member 17, a thickness of the vibration isolation member 17 can be set within, for example, a range of 2 mm to 20 mm.

The vibration isolation member 17 has one surface 17*a* facing the one surface 51*a* of the head 51, and the other surface 17*b* facing the inner surface 34*a* of the cover member 34. The one surface 17*a* and the other surface 17*b* are flat surfaces. The other surface 17*b* is a surface disposed on a side opposite the one surface 17*a*.

The one surface 17*a* of the vibration isolation member 17 is bonded to the one surface 51*a* of the head 51 via the first adhesive layer 18A. The other surface 17*b* of the vibration isolation member 17 is bonded to the inner surface 34*a* of the cover member 34 via the second adhesive layer 18B.

For example, vulcanizing adhesive agents, moisture-curing adhesive agents, or the like can be used as the first and second adhesive layers 18A and 18B.

In such a manner, since the vibration isolation member 17 is provided that is disposed between the one surface 51*a* (flat surface) of the head 51 of the bolt 16 and the inner surface 34*a* of the cover member 34 and that is bonded to the one surface 51*a* of the head 51 and to the inner surface 34*a* of the cover member 34, even when the cover member 34 is displaced in a direction away from the head 51 of the bolt 16, a state where the vibration isolation member 17 is connected to the head 51 and to the cover member 34 can be maintained.

Accordingly, the state where the vibration isolation member 17 is connected to the head 51 and to the cover member 34 can be maintained without depending on displacement directions of the cover member 34 (in this case, a direction where the cover member 34 is separated from the head 51 of the bolt 16 and a direction where the cover member 34 approaches the head 51 of the bolt 16).

Therefore, when the cover member 34 vibrates, the vibration of the cover member 34 can be suppressed by the vibration isolation member 17, so that noise caused by the vibration of the cover member 34 can be reduced.

A shape of the vibration isolation member 17 can be, for example, a circular columnar shape having a diameter equal to a diameter of the one surface 51*a* of the head 51 having a circular shape. In this case, shapes of the one surface 17*a* and the other surface 17*b* of the vibration isolation member 17 are a circular shape.

In FIG. 3, the case where the vibration isolation member 17 is bonded to the one surface 51*a* of the head 51 and to the inner surface 34*a* of the cover member 34 using the first and second adhesive layers 18A and 18B has been described as an example; however, for example, when the vibration isolation member 17 itself is a material having a tackiness property and an adhesive property, the vibration isolation member 17 may be bonded to the one surface 51*a* of the head 51 and to the inner surface 34*a* of the cover member 34 without using the first and second adhesive layers 18A and 18B.

The inverter device 19 is accommodated in the accommodation casing 15. The inverter device 19 includes high-voltage components (not illustrated), a power substrate (not illustrated), a CPU substrate 58 including an electronic component 57 and the circuit substrate 55, and an inverter module (not illustrated).

For example, components such as a smoothing capacitor, a normal mode coil, and a common mode coil provided in a high-voltage power supply line (not illustrated) can be used as the high-voltage components (not illustrated).

A structure formed of, for example, a circuit substrate, a plurality of power semiconductor switching elements (IGBTs) mounted on the circuit substrate, and a power control circuit that operates the power semiconductor switching elements can be used as the power substrate (not illustrated).

The circuit substrate 55 includes a substrate body (not illustrated) and a circuit pattern (not illustrated) formed on the substrate body. The circuit substrate 55 is fixed to the tip surface 32*a* of the substrate support portion 32.

The circuit substrate 55 has the one surface 55*a* that is in contact with the tip surface 32*a* of the substrate support portion 32; the other surface 55*b* facing the inner surface 34*a* of the cover member 34; and the through-hole 55A into which the shank 52 of the bolt 16 is inserted.

The electronic component 57 is mounted on the other surface 55*b* of the circuit substrate 55. For example, an element such as a CPU that operates at a low voltage can be used as the electronic component 57.

Figure 5:
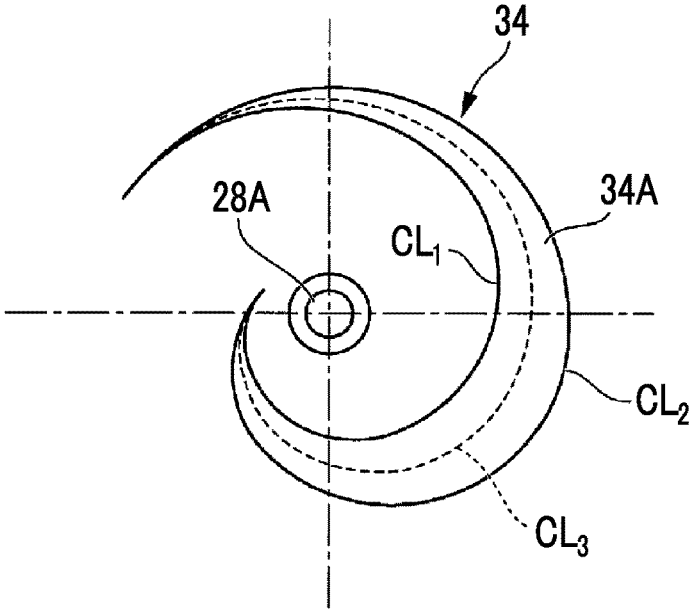
FIG. 5 is a view schematically illustrating a discharge port and a compression chamber formed at a position closest to the discharge port among a plurality of compression chambers in the state illustrated in FIG. 4 (stage where a refrigerant gas is discharged).

FIG. 5 is a view schematically illustrating the discharge port and the compression chamber that is formed at the position closest to the discharge port among the plurality of compression chambers in the state (refrigerant gas discharge state) illustrated in FIG. 4. In FIG. 5, the same components as those of the structure illustrated in FIG. 4 are denoted by the same reference signs.

Here, an exemplary eigenvalue E of the cover member 34 will be described with reference to FIGS. 1, 4, and 5.

Referring to FIG. 5, an average value $S_{AV}$ (mm) of a length $S_1$ (mm) of an inner curved line $CL_1$ of the fixed scroll 41 that partitions the compression chamber 44A formed on an innermost side among the plurality of compression chambers 44 in a stage where the compressor 13 discharges the refrigerant gas (refrigerant) from the discharge port 28A (state illustrated in FIG. 4), and of a length $S_2$ (mm) of an outer curved line $CL_2$ of the movable scroll 42 that partitions the compression chamber 44A formed on the innermost side is calculated by the following equation (3). The average value $S_{AV}$ (representative length) is a value corresponding to a length of a center curved line $CL_3$ illustrated in FIG. 5.

$$S_{AV}=(S_1+S_2)/2 \quad (3)$$

Then, the eigenvalue E (kHz) of the cover member 34 may be set to satisfy the following equation (4).

$$E \geq V/S_{AV} \quad (4)$$

However, in the equation (4), V (m/s) is a sound speed of the refrigerant gas (refrigerant).

In such a manner, since the eigenvalue E of the cover member 34 is set to satisfy the equation (4), when vibration of the compressor 13 is transmitted to the accommodation portion body 31, the vibration of the cover member 34 can be suppressed by the vibration isolation member 17, so that noise caused by the vibration of the cover member 34 can be reduced.

In addition, since the cover member 34 having the eigenvalue E satisfying the equation (4), and the vibration isolation member 17 bonded to the one surface 51*a* of the head 51 and to the inner surface 34*a* of the cover member 34 are provided, the effect of suppressing vibration of the cover member 34 can be enhanced, so that noise caused by the vibration of the cover member 34 can be further reduced.

Here, a specific example of the eigenvalue E (kHz) of the cover member 34 will be described.

When R-134a that is a fluorine-based refrigerant is used as the refrigerant gas (refrigerant), a sound speed V of the refrigerant is approximately 150 m/s to 180 m/s.

In a case where a 33 cc scroll compressor is used as the compressor 13 for a vehicle air conditioner, when the length $S_1$ is 79.97 mm and the length $S_2$ is 103.09 mm, the average value $S_{AV}$ of these two lengths is 91.53 mm.

When V=180 m/s, $S_{AV}$=91.53 mm, and V=180 m/s are substituted into the equation (4), E 1.97 (kHz).

Therefore, in the case of the above-described conditions, when the eigenvalue E of the cover member 34 is 1.97 kHz or more, vibration of the cover member 34 can be suppressed, and noise caused by the vibration of the cover member 34 can be reduced.

According to the electric compressor 10 of the first embodiment, since the vibration isolation member 17 is provided that is disposed between the one surface 51*a* (flat surface) of the head 51 of the bolt 16 and the inner surface 34*a* of the cover member 34 and that is bonded to the one surface 51*a* of the head 51 and to the inner surface 34*a* of the cover member 34, when the cover member 34 is displaced in the direction away from the head 51 of the bolt 16, the state where the vibration isolation member 17 is connected to the head 51 and to the cover member 34 can be maintained.

Accordingly, when vibration of the compressor 13 is transmitted to the accommodation portion body 31, the vibration isolation member 17 is capable of suppressing vibration of the cover member 34 without depending on the displacement directions of the cover member 34 (in this case, the direction where the cover member 34 is separated from the head 51 of the bolt 16 and the direction where the cover member 34 approaches the head 51 of the bolt 16), so that noise caused by the vibration of the cover member 34 can be reduced.

In the electric compressor 10 of the first embodiment, the case where the inner surface 34*a* of the cover member 34 and the one surface 51*a* of the head 51 are bonded to the vibration isolation member 17 using the first and second adhesive layers 18A and 18B has been described as an example; however, for example, when a vibration isolation member having a surging frequency equal to or higher than a frequency of a primary eigenvalue of the cover member 34 (equal to or higher than a frequency that has to be damped) is used as the vibration isolation member 17, a vibration isolation member having a surging frequency equal to or higher than the frequency of the primary eigenvalue of the cover member 34 (equal to or higher than a frequency that has to be damped) may be used as the vibration isolation member without bonding the inner surface 34*a* of the cover member 34 and the one surface 51*a* of the head 51 to the vibration isolation member 17.

In such a manner, since the vibration isolation member 17 is provided that is disposed between the one surface 51*a* of the head 51 of the bolt 16 and the inner surface 34*a* of the cover member 34 and that has a surging frequency equal to or higher than the frequency of the primary eigenvalue of the cover member 34, the vibration isolation member 17 is capable of fully following a displacement of the cover member 34 even without bonding the one surface 51*a* of the head 51 of the bolt 16 and the inner surface 34*a* of the cover member 34 to the vibration isolation member 17, so that noise caused by vibration of the cover member 34 can be reduced.

In addition, when the first and second adhesive layers 18A and 18B are not used, an initial crushing amount (initial displacement) may be set to be larger than a vibration displacement at the frequency that has to be damped. Accordingly, noise caused by vibration of the cover member 34 can be further reduced by using the vibration isolation member 17.

When the first and second adhesive layers 18A and 18B are used, a vibration isolation member may be used that has a surging frequency equal to or higher than the frequency (equal to or higher than the frequency that has to be damped) of the primary eigenvalue of the cover member 34.

Second Embodiment

Figure 6:
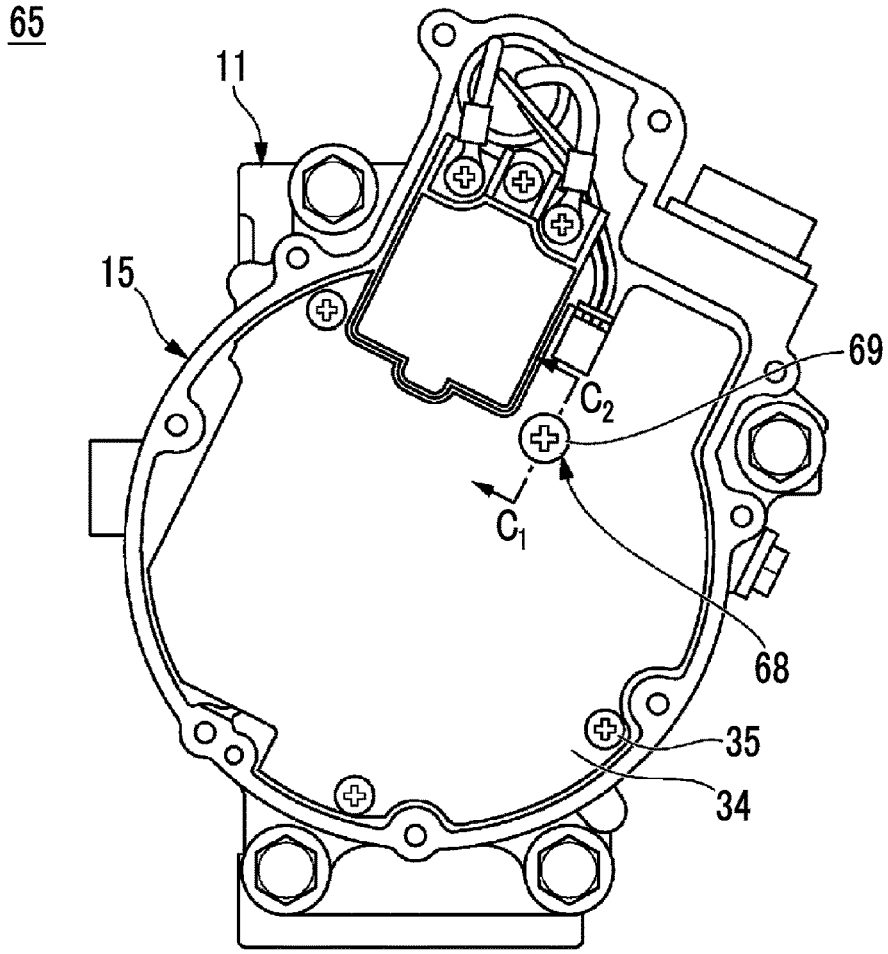
FIG. 6 is a side view illustrating a schematic configuration of an electric compressor according to a second embodiment of the present invention.

FIG. 6 is a side view illustrating a schematic configuration of an electric compressor according to a second embodiment of the present invention. In FIG. 6, the same components as those of the structure illustrated in FIG. 1 are denoted by the same reference signs.

Figure 7:
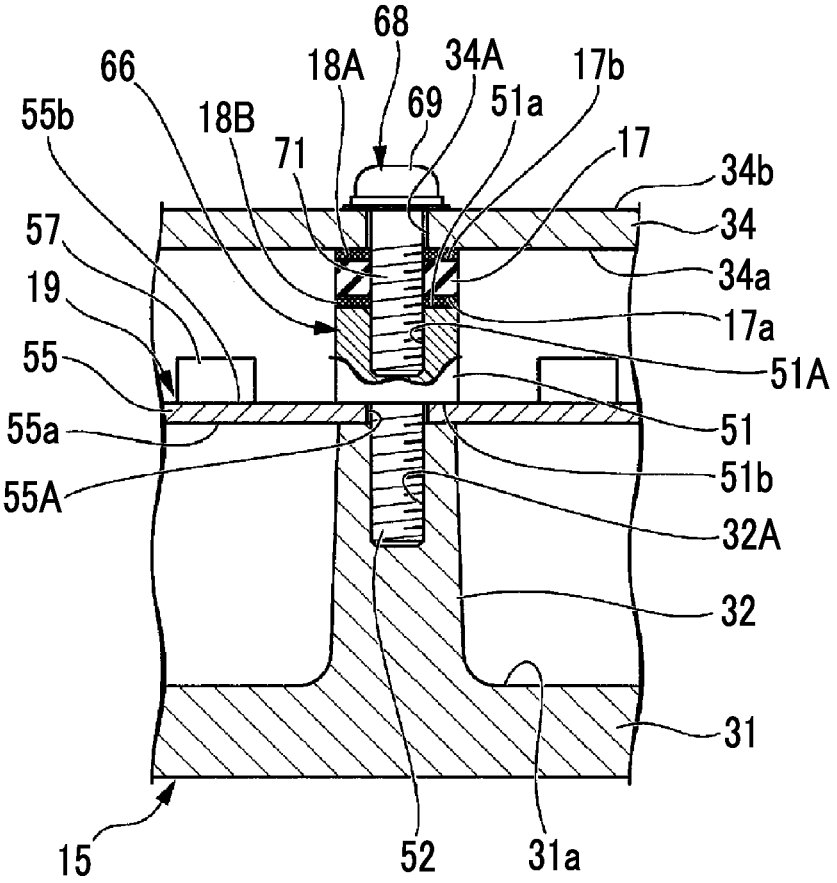
FIG. 7 is a cross-sectional view of an accommodation casing illustrated in FIG. 6 taken along line $C_1$-$C_2$.

FIG. 7 is a cross-sectional view of an accommodation casing illustrated in FIG. 6 taken along line $C_1$-$C_2$. In FIG. 7, the same components as those of the structure illustrated in FIG. 3 described in the first embodiment are denoted by the same reference signs.

Referring to FIGS. 6 and 7, an electric compressor 65 of the second embodiment has the same configuration as that of the electric compressor 10 except that a bolt 66 is provided instead of the bolt 16 forming the electric compressor 10 of the first embodiment and except that the electric compressor 65 includes a through-hole 34A provided in the cover member 34 and a screw 68.

The bolt 66 has the same configuration as that of the bolt 16 except that the head 51 has a screw hole 51A. The bolt 66 is fastened to the screw hole 32A of the substrate support portion 32 in a state where the bolt 66 is inserted into the through-hole 55A provided in the circuit substrate 55.

The screw hole 51A is exposed from the one surface 51*a* of the head 51, and extends in a direction from the one surface 51*a* toward the shank 52. A depth of the screw hole 51A is smaller than a thickness of the head 51.

The through-hole 34A is formed to penetrate through a portion of the cover member 34 that faces the screw hole 51A.

The screw 68 includes a head 69 and a shank 71 integrated with the head 69. The screw 68 is screwed into the screw hole 51A provided in the head 51 in a state where the shank 71 is inserted into the through-hole 34A from outside the cover member 34. In this state, the shank 71 of the screw 68 penetrates through the first adhesive layer 18A, through the vibration isolation member 17, and through the second adhesive layer 18B.

According to the electric compressor 65 of the second embodiment, in addition to the vibration isolation member 17, the first adhesive layer 18A, and the second adhesive layer 18B, the screw 68 is provided that penetrates through the cover member 34 and through the vibration isolation member 17 from outside the cover member 34 to be screwed into the screw hole 51A provided in the head 51 of the bolt 66, so that the displacement of the cover member 34 in the direction away from the head 51 can be restricted, and the strength of connection between the inner surface 34*a* of the cover member 34 and the vibration isolation member 17 can be increased.

Accordingly, the effect of suppressing vibration of the cover member 34 can be enhanced, so that the effect of reducing noise caused by the vibration of the cover member 34 can be enhanced.

In addition, the eigenvalue E of the cover member 34 forming the electric compressor 65 of the second embodiment may be set to satisfy the equation (4) described in the first embodiment.

In the electric compressor 65 of the second embodiment, the case where the inner surface 34*a* of the cover member 34 and the one surface 51*a* of the head 51 are bonded to the vibration isolation member 17 using the first and second adhesive layers 18A and 18B has been described as an example; however, for example, a vibration isolation member having a surging frequency equal to or higher than the frequency of the primary eigenvalue of the cover member 34 (equal to or higher than a frequency that has to be damped) may be used as the vibration isolation member 17 without bonding the inner surface 34*a* of the cover member 34 and the one surface 51*a* of the head 51 to the vibration isolation member 17.

In such a manner, since the vibration isolation member 17 is provided that is disposed between the one surface 51*a* of the head 51 of the bolt 16 and the inner surface 34*a* of the cover member 34 and that has a surging frequency equal to or higher than the frequency of the primary eigenvalue of the cover member 34, the vibration isolation member 17 is capable of fully following a displacement of the cover member 34 even without bonding the one surface 51*a* of the head 51 of the bolt 16 and the inner surface 34*a* of the cover member 34 to the vibration isolation member 17, so that noise caused by vibration of the cover member 34 can be reduced.

In addition, when the first and second adhesive layers 18A and 18B are not used, an initial crushing amount (initial displacement) may be set to be larger than a vibration displacement at the frequency that has to be damped. Accordingly, noise caused by vibration of the cover member 34 can be further reduced by using the vibration isolation member 17.

When the first and second adhesive layers 18A and 18B are used, a vibration isolation member may be used that has a surging frequency equal to or higher than the frequency (equal to or higher than the frequency that has to be damped) of the primary eigenvalue of the cover member 34.

Third Embodiment

Figure 8:
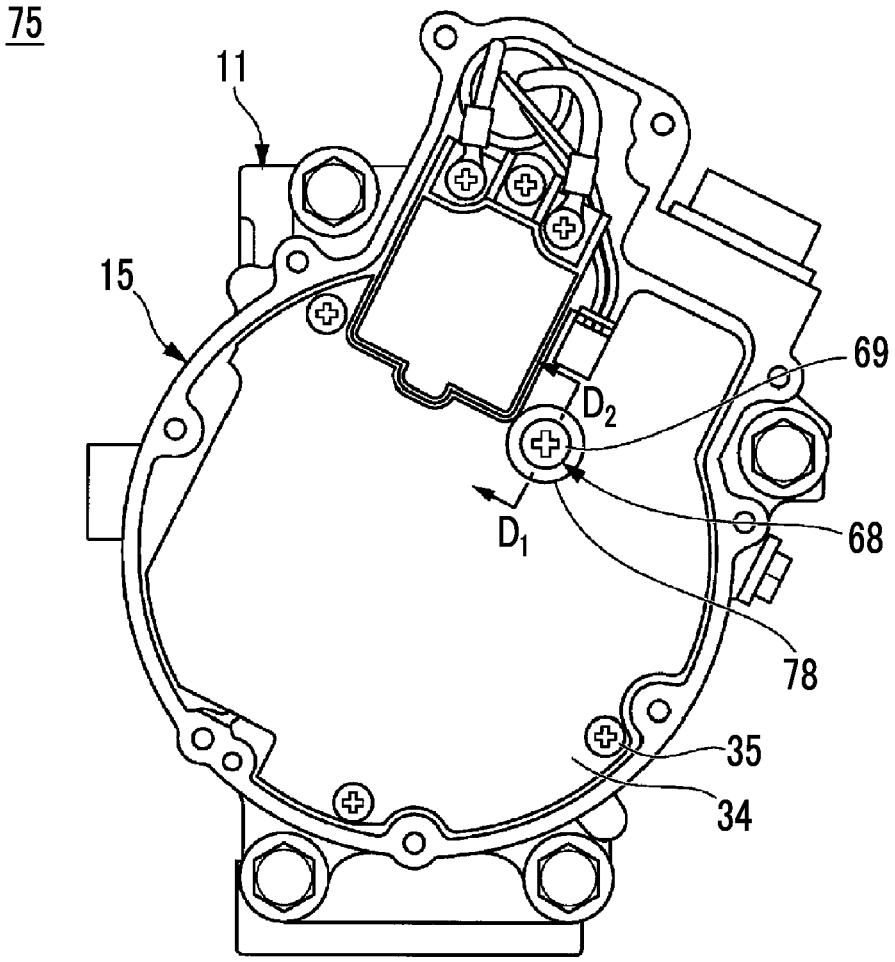
FIG. 8 is a side view illustrating a schematic configuration of an electric compressor according to a third embodiment of the present invention.

FIG. 8 is a side view illustrating a schematic configuration of an electric compressor according to a third embodiment of the present invention. In FIG. 8, the same components as those of the structure illustrated in FIG. 6 are denoted by the same reference signs.

Figure 9:
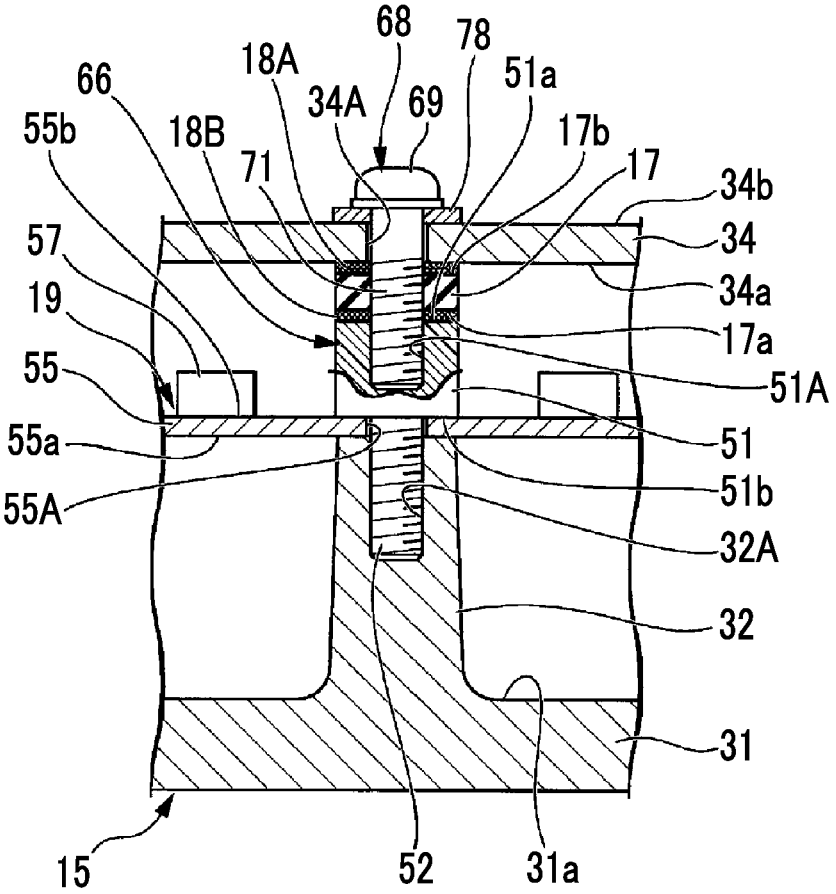
FIG. 9 is a cross-sectional view of an accommodation casing illustrated in FIG. 8 taken along line $D_1$-$D_2$.

FIG. 9 is a cross-sectional view of an accommodation casing illustrated in FIG. 8 taken along line $D_1$-$D_2$. In FIG. 9, the same components as those of the structure illustrated in FIG. 7 described in the second embodiment are denoted by the same reference signs.

Referring to FIGS. 8 and 9, an electric compressor 75 of the third embodiment has the same configuration as that of the electric compressor 65 except that a gasket 78 is further provided to the configuration of the electric compressor 65 of the second embodiment.

The gasket 78 has a hole (not illustrated) through which the shank 71 of the screw 68 is capable of passing. The gasket 78 is disposed on the outer surface 34*b* of the cover member 34 such that the hole faces the through-hole 34A provided in the cover member 34.

For example, a gasket of which a surface is coated with rubber can be used as the gasket 78.

The screw 68 is screwed into the screw hole 51A via the gasket 78, the cover member 34, the first adhesive layer 18A, the vibration isolation member 17, and the second adhesive layer 18B.

According to the electric compressor 75 of the third embodiment, since the gasket 78 disposed on the outer surface 34*b* of the cover member 34 is provided and the screw 68 is screwed into the screw hole 51A via the gasket 78, when the gasket 78 is made of metal, the loosening of the screw 68 can be prevented. In addition, when the gasket 78 is made of rubber, vibration of the cover member can be suppressed by using the vibration isolation member 17 and the gasket 78, so that the effect of reducing noise caused by the vibration of the cover member 34 can be further enhanced.

The eigenvalue E of the cover member 34 forming the electric compressor 75 of the third embodiment may also be set to satisfy the equation (4) described in the first embodiment.

Figure 10:
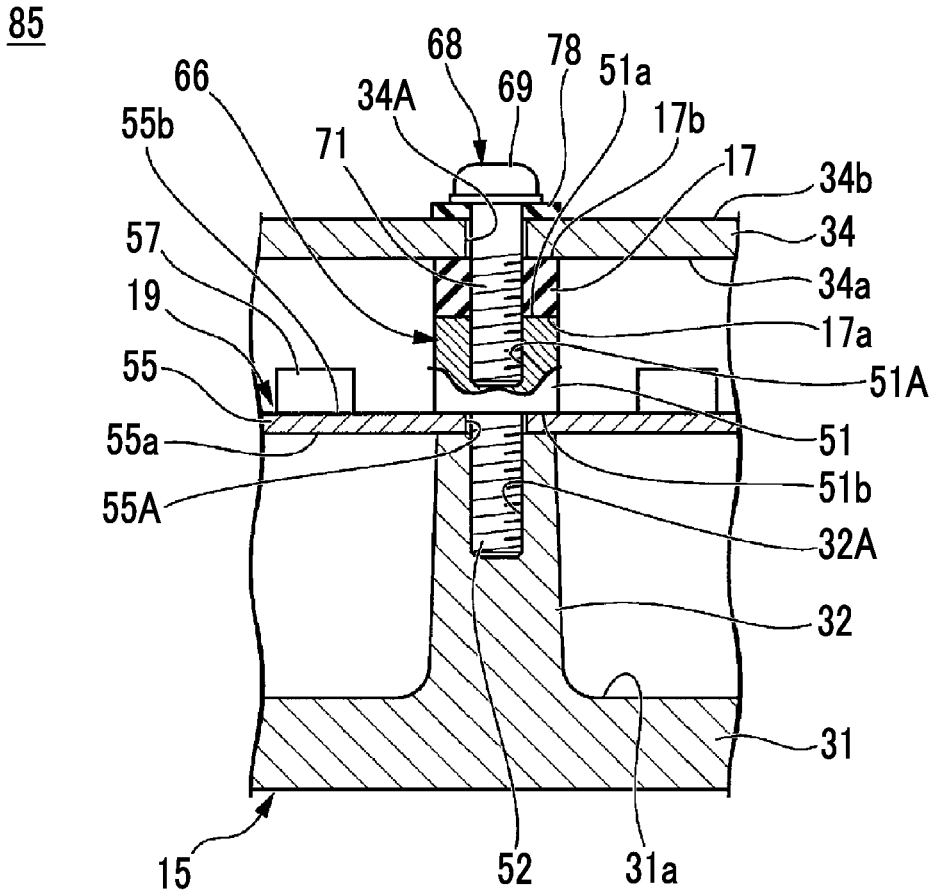
FIG. 10 is a cross-sectional view of a principal section of an electric compressor according to a modification example of the third embodiment of the present invention.

FIG. 10 is a cross-sectional view of a principal section of an electric compressor according to a modification example of the third embodiment of the present invention. In FIG. 10, the same components as those of the structure illustrated in FIG. 7 described in the third embodiment are denoted by the same reference signs.

Referring to FIG. 10, an electric compressor 85 of a modification example of the third embodiment has the same configuration as that of the electric compressor 75 except that the first and second adhesive layers 18A and 18B are eliminated from the configuration of the electric compressor 75 of the third embodiment and a gasket having a vibration isolation function is used as the gasket 78. For example, a gasket of which a surface is coated with rubber can be used as the gasket 78.

Namely, in the electric compressor 85, in a state where the cover member 34 is stationary, the inner surface 34*a* of the cover member 34 and the one surface 51*a* of the head 51 are in contact with the vibration isolation member 17, and the outer surface 34*b* of the cover member 34 and the gasket 78 are in contact with each other.

Therefore, when the cover member 34 vibrates and the cover member 34 is displaced from a stationary position in a direction where the cover member 34 approaches the head 69, even if the vibration isolation member 17 is separated from the inner surface 34*a* of the cover member 34, vibration of the cover member 34 can be suppressed by the gasket 78 since the gasket 78 abuts on the head 69 and on the outer surface 34*b* of the cover member 34.

On the other hand, when the cover member 34 vibrates and the cover member 34 is displaced from the stationary position in a direction away from the head 69 (direction toward the circuit substrate 55), even if the gasket 78 is separated from the outer surface 34*b* of the cover member 34, vibration of the cover member 34 can be suppressed by the vibration isolation member 17 since the vibration isolation member 17 abuts on the one surface 51*a* of the head 51 and on the inner surface 34*a* of the cover member 34.

Namely, according to the electric compressor 85 of the modification example of the third embodiment, vibration of the cover member 34 can be suppressed by the simplified configuration without using the first and second adhesive layers 18A and 18B (in other words, without bonding the vibration isolation member 17 to the head 51 of the bolt 66 and to the inner surface 34*a* of the cover member 34).

The eigenvalue E of the cover member 34 forming the electric compressor 85 of the modification example of the third embodiment may also be set to satisfy the equation (4) described in the first embodiment.

For example, a gasket having a surging frequency equal to or higher than the frequency of the primary eigenvalue of the cover member 34 (equal to or higher than a frequency that has to be damped) may be used as the gasket 78 forming the electric compressor 75 or 85 described above. Noise caused by vibration of the cover member 34 can be reduced by using the gasket 78 having such a configuration.

Fourth Embodiment

Figure 11:
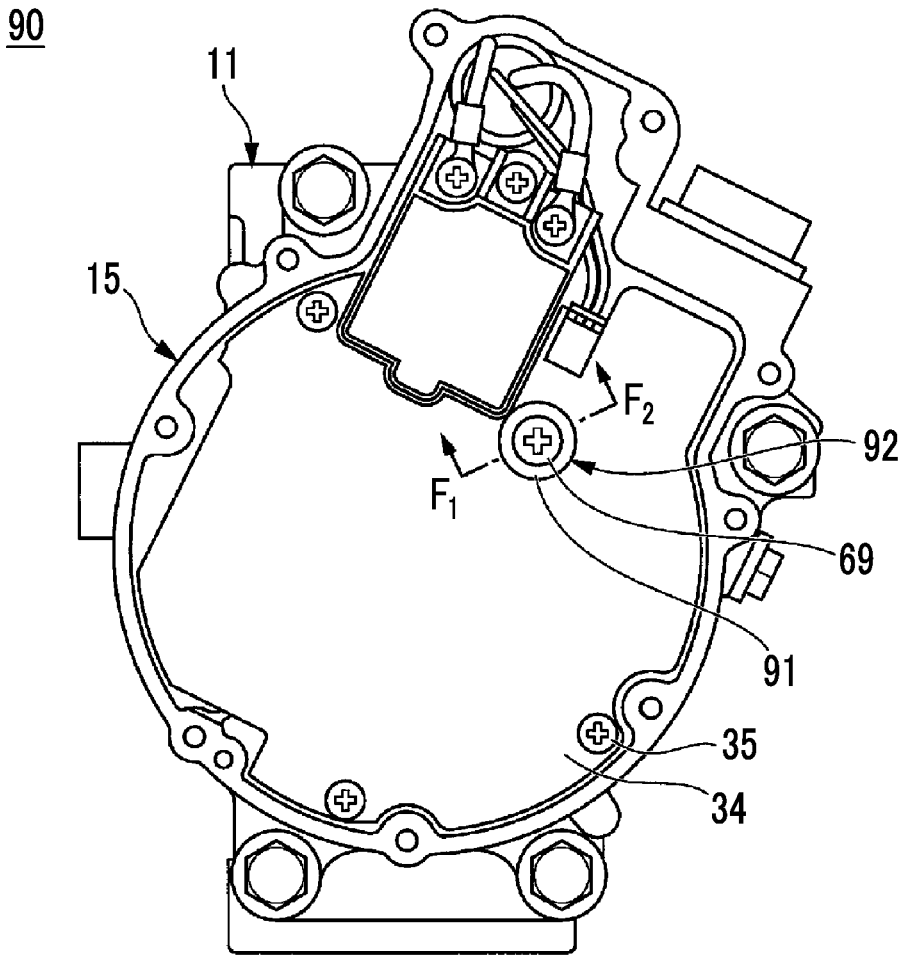
FIG. 11 is a side view illustrating a schematic configuration of an electric compressor according to a fourth embodiment of the present invention.

FIG. 11 is a side view illustrating a schematic configuration of an electric compressor according to a fourth embodiment of the present invention. In FIG. 11, the same components as those of the structure illustrated in FIG. 3 are denoted by the same reference signs.

Figure 12:
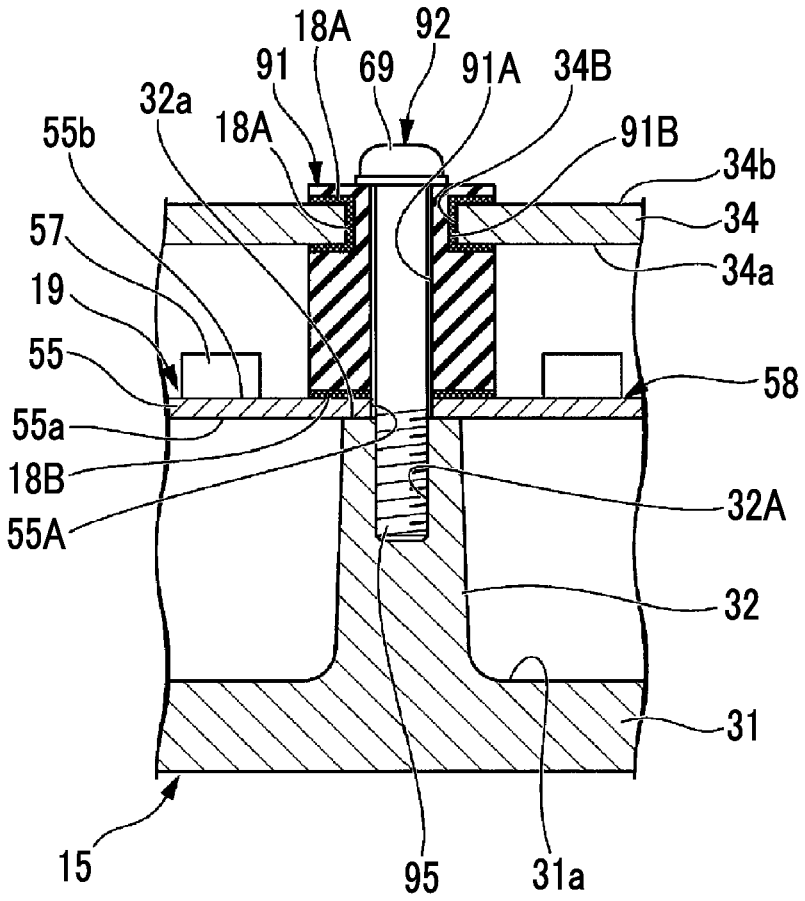
FIG. 12 is a cross-sectional view of an accommodation casing illustrated in FIG. 11 taken along line $F_1$-$F_2$.

FIG. 12 is a cross-sectional view of an accommodation casing illustrated in FIG. 11 taken along line $F_1$-$F_2$. In FIG. 12, the same components as those of the structure illustrated in FIG. 3 described in the first embodiment are denoted by the same reference signs.

Referring to FIGS. 11 and 12, an electric compressor 90 of the fourth embodiment has the same configuration as that of the electric compressor 10 except that a grommet 91 having a vibration isolation property and a screw 92 are provided instead of the bolt 16 and the vibration isolation member 17 forming the electric compressor 10 of the first embodiment and except that the cover member 34 has a through-hole 34B in which the grommet 91 is disposed.

The through-hole 34B is provided to penetrate through a portion of the cover member 34 that faces the substrate support portion 32. A diameter of the through-hole 34B is sized such that the cover member 34 which partitions a periphery of the through-hole 34B can be accommodated in a ring-shaped groove to be described provided in the grommet 91.

The grommet 91 has a screw through-hole 91A penetrating through a center of the grommet 91, and a ring-shaped groove 91B. The ring-shaped groove 91B is formed by cutting out a part of a side wall of the grommet 91 in a ring shape.

A portion of the cover member 34 that is inserted into the ring-shaped groove 91B is bonded to the grommet that partitions the ring-shaped groove 91B, by the first adhesive layer 18A.

In addition, an end surface of two end surfaces of the grommet 91 which faces the other surface 55*b* of the circuit substrate 55 is bonded to the other surface 55*b* of the circuit substrate 55 by the second adhesive layer 18B.

For example, a grommet made of rubber can be used as the grommet 91.

A thickness of the grommet 91 in an extending direction of the screw through-hole 91A is set to be larger than a distance from the other surface 55*b* of the circuit substrate 55 to the outer surface 34*b* of the cover member 34. Accordingly, the grommets 91 are disposed on both an inner surface 34*a* side and an outer surface 34*b* side of the cover member 34.

The screw 92 has the same configuration as that of the screw 68 except that the screw 92 includes a shank 95 having a length longer than that of the shank 71 of the screw 68 described with reference to FIG. 7. The length of the shank 95 is set to such a length that the shank 95 can be screwed into the screw hole 32A provided in the substrate support portion 32.

The screw 92 having the above configuration is screwed into the screw hole 32A in a state where the shank 95 is inserted into the through-hole 34B from outside the cover member 34. Accordingly, the shank 95 penetrates through the grommet 91 and through the second adhesive layer 18B.

According to the electric compressor 90 of the fourth embodiment, the configuration is such that the grommet 91 having a vibration isolation property that includes the ring-shaped groove 91B accommodating a portion of the cover member 34 located around the through-hole 34B and that is mounted in the through-hole 34B, and the screw 92 that penetrates through the grommet 91 from outside the cover member 34 to be screwed to the substrate support portion 32 are provided, and the grommet 91 is bonded to the other surface 55*b* of the circuit substrate 55 and to the cover member 34. Therefore, when the cover member 34 is displaced in the direction away from the circuit substrate 55, a state where the grommet 91 is connected to the other surface 55*b* of the circuit substrate 55 and to the cover member can be maintained.

For this reason, vibration of the cover member 34 can be suppressed by the grommet 91, so that noise caused by the vibration of the cover member 34 can be reduced.

In addition, since a part of the grommet 91 is disposed not only between the circuit substrate 55 and the cover member 34 but also on an outer side (outer surface 34*b*) of the cover member 34, the effect of reducing noise caused by vibration of the cover member 34 can be further enhanced.

The eigenvalue E of the cover member 34 forming the electric compressor 90 of the fourth embodiment may also be set to satisfy the equation (4) described in the first embodiment.

Figure 13:
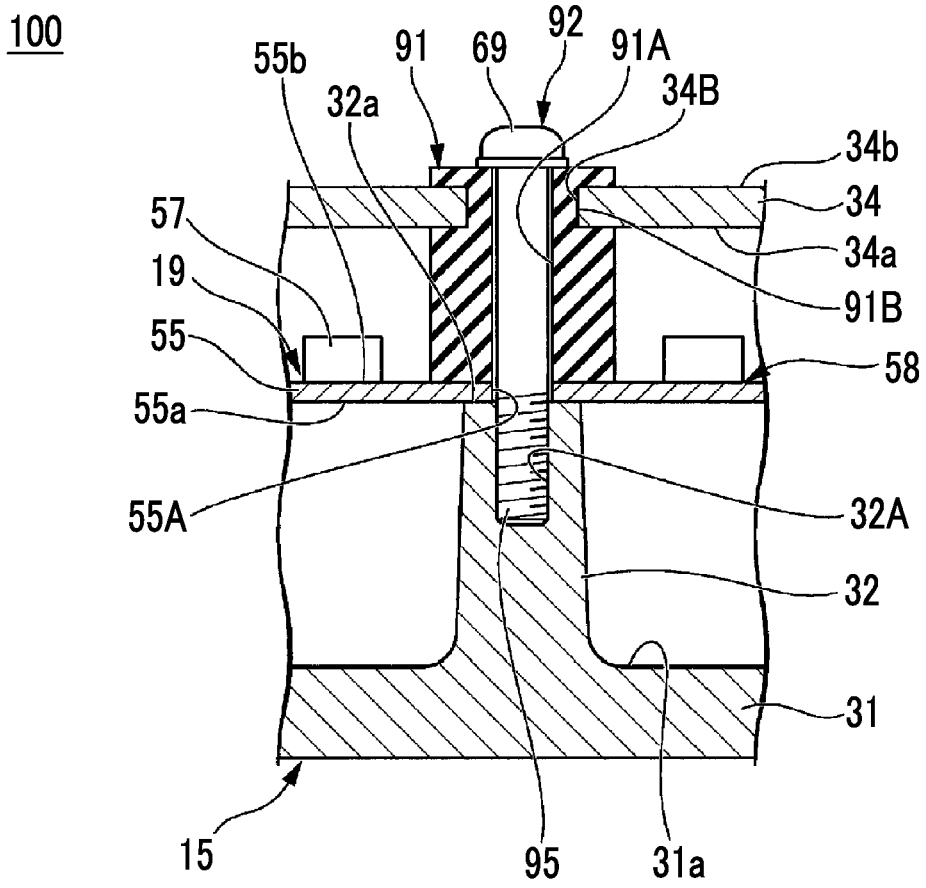
FIG. 13 is a cross-sectional view of a principal section of an electric compressor according to a modification example of the fourth embodiment of the present invention.

FIG. 13 is a cross-sectional view of a principal section of an electric compressor according to a modification example of the fourth embodiment of the present invention. In FIG. 13, the same components as those of the structure illustrated in FIG. 12 described in the fourth embodiment are denoted by the same reference signs.

Referring to FIG. 13, an electric compressor 100 of a modification example of the fourth embodiment has the same configuration as that of the electric compressor 90 except that the first and second adhesive layers 18A and 18B are eliminated from the configuration of the electric compressor 90 of the fourth embodiment.

In the electric compressor 100, a part of the grommet 91 is disposed on both the inner surface 34*a* and the outer surface 34*b* of the cover member 34, and the inner surface 34*a* and the outer surface 34*b* of the cover member 34 are in contact with the grommet 91 in a state where the cover member 34 is stationary.

In the electric compressor 100, when the cover member 34 vibrates and the cover member 34 is displaced from a stationary position in the direction away from the circuit substrate 55, even if the grommet 91 is separated from the inner surface 34*a* of the cover member 34, a part of the grommet 91 disposed on the outer side of the cover member 34 abuts on the outer surface 34*b* of the cover member 34 and on the head 69 of the screw 92, so that vibration of the cover member 34 can be suppressed by the grommet 91 disposed on the outer side of the cover member 34.

On the other hand, when the cover member 34 vibrates and the cover member 34 is displaced from the stationary position in the direction toward the circuit substrate 55, even if the grommet 91 is separated from the outer surface 34*b* of the cover member 34, a part of the grommet 91 abuts on the inner surface 34*a* of the cover member 34 and on the other surface 55*b* of the circuit substrate 55, so that vibration of the cover member 34 can be suppressed by the grommet 91 disposed on an inner side of the cover member 34.

Namely, according to the electric compressor 100 of the modification example of the fourth embodiment, vibration of the cover member 34 can be suppressed by the simplified configuration without using the first and second adhesive layers 18A and 18B.

The eigenvalue E of the cover member 34 forming the electric compressor 100 of the modification example of the fourth embodiment may also be set to satisfy the equation (4) described in the first embodiment.

For example, a grommet having a surging frequency equal to or higher than the frequency of the primary eigenvalue of the cover member 34 (equal to or higher than a frequency that has to be damped) may be used as the grommet 91 forming the electric compressor 90 or 100 described above. Noise caused by vibration of the cover member 34 can be reduced by using the grommet 91 having such a configuration.

Fifth Embodiment

Figure 14:
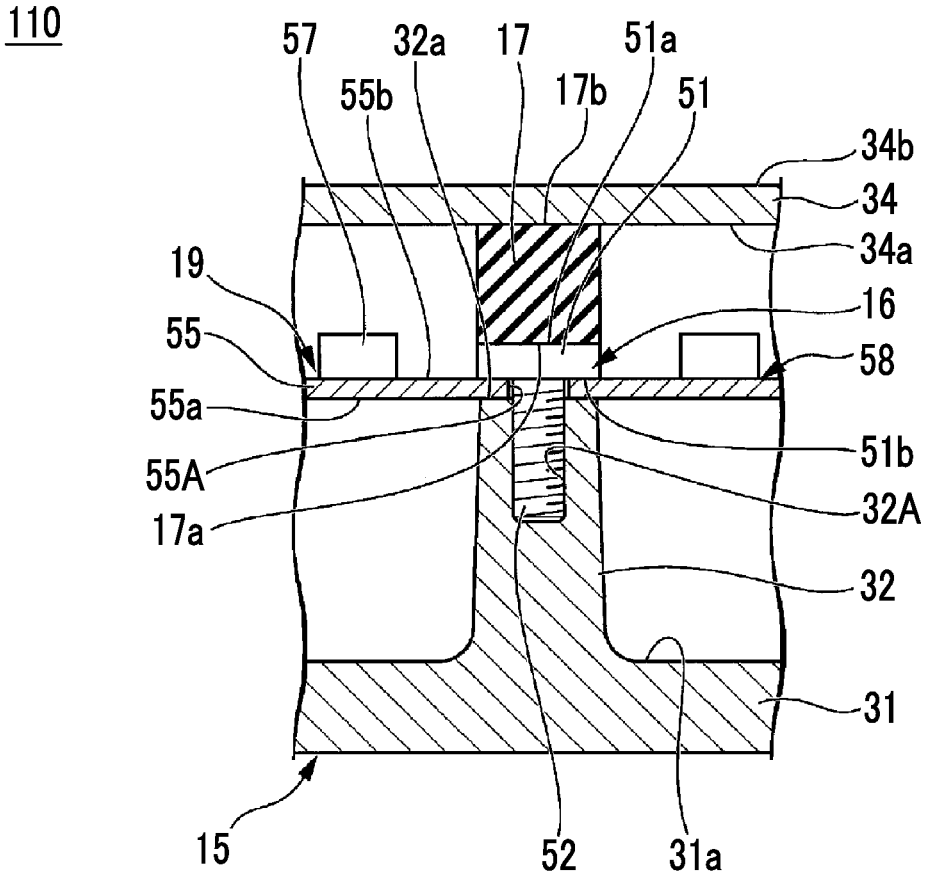
FIG. 14 is a cross-sectional view of a principal section of an electric compressor according to a fifth embodiment of the present invention.

FIG. 14 is a cross-sectional view of a principal section of an electric compressor according to a fifth embodiment of the present invention. In FIG. 14, the same components as those of the structure illustrated in FIG. 3 described in the first embodiment are denoted by the same reference signs.

Referring to FIG. 14, an electric compressor 110 of the fifth embodiment has the same configuration as that of the electric compressor 10 except that the first and second adhesive layers 18A and 18B are eliminated from the configuration of the electric compressor 10 of the first embodiment and except that the eigenvalue E of the cover member 34 is set to satisfy the equation (4) described in the first embodiment.

In the electric compressor 110 of the fifth embodiment having such a configuration, since vibration of the cover member 34 can be suppressed without bonding the vibration isolation member 17 to the inner surface 34*a* of the cover member 34 and to the one surface 51*a* of the head 51 using the first and second adhesive layers 18A and 18B, noise caused by the vibration of the cover member 34 can be reduced by the simple configuration.

In addition, the cover member 34 having the eigenvalue E satisfying the equation (4) is applicable to an electric compressor (specifically, an electric compressor in which the first and second adhesive layers 18A and 18B illustrated in FIG. 3 are not provided at both ends of the vibration isolation member 17) other than the structure illustrated in FIG. 14.

For example, a vibration isolation member having a surging frequency equal to or higher than the frequency of the primary eigenvalue of the cover member 34 (equal to or higher than a frequency that has to be damped) may be used as the vibration isolation member 17 forming the electric compressor 110 described above. Noise caused by vibration of the cover member 34 can be reduced by using the vibration isolation member 17 having such a configuration.

The exemplary embodiments of the present invention have been described in detail above; however, the present invention is not limited to such specific embodiments, and various modifications and changes can be made without departing from the concept of the present invention described in the claims.

REFERENCE SIGNS LIST

10, 65, 75, 85, 90, 100, 110 Electric compressor
11 Housing

12 Electric motor
13 Compressor
14 Motor shaft
15 Accommodation casing
16, 66 Bolt
17 Vibration isolation member
17*a*, 51*a*, 55*a* One surface
17*b*, 51*b*, 55*b* The other surface
18A First adhesive layer
18B Second adhesive layer
19 Inverter device
21 First housing portion
22 Second housing portion
24, 27 Housing main body
25 Refrigerant suction port
28 Discharge portion
28A Discharge port
31 Accommodation portion body
31*a* Bottom surface
31A Opening
32 Substrate supporting portion
32*a* Tip surface
32A, 51A Screw hole
34 Cover member
34*a* Inner surface
34*b* Outer surface
34A, 34B, 55A Through-hole
35, 68, 92 Screw
41 Fixed scroll
42 Movable scroll
44, 44A Compression chamber
51, 69 Head
52, 71, 95 Shank
55 Circuit substrate
57 Electronic component
58 CPU substrate
78 Gasket
91 Grommet
91A Screw through-hole
91B Ring-shaped groove
$CL_1$ Inner curved line
$CL_2$ Outer curved line
$CL_3$ Center curved line
θ Position angle

The invention claimed is:

1. An electric compressor comprising:

a housing that accommodates a compressor and an electric motor that drives the compressor;

an inverter device including a circuit substrate on which an electronic component is mounted;

an accommodation casing including an accommodation portion body provided on a side surface of the housing to accommodate the inverter device, a substrate support portion that protrudes to an inside of the accommodation portion body to support one surface of the circuit substrate, and a cover member fixed to the accommodation portion body to close an opening of the accommodation portion body;

a bolt which is fastened to the substrate support portion to restrict a position of the circuit substrate with respect to the substrate support portion, and in which one surface of a head facing an inner surface of the cover member is flat; and a first vibration isolation member that is disposed between the one surface of the head and the inner surface of the cover member and that is bonded to the one surface of the head and to the inner surface of the cover member, wherein the compressor includes a fixed scroll and a movable scroll each having a spiral shape, a plurality of compression chambers that are formed between the fixed scroll and the movable scroll to compress a refrigerant by means of a movement of the movable scroll, and a discharge port that discharges the compressed refrigerant, when an average value of a length S1 (mm) of an inner curved line of the fixed scroll in a stage where the compressor discharges the refrigerant from the discharge port, the fixed scroll partitioning a compression chamber formed on an innermost side among the plurality of compression chambers, and of a length S2 (mm) of an outer curved line of the movable scroll that partitions the compression chamber formed on the innermost side is an average value $S_{AV}$ (mm), an eigenvalue E (kHz) of the cover member satisfies the following equation (1): $E \geq V/S_{AV}$ . . . (1) here, in the equation (1), V (m/s) is a sound speed of the refrigerant.

2. The electric compressor according to claim 1, wherein the head is provided with a screw hole, and a gasket disposed on an outer surface of the cover member, and a screw screwed into the screw hole via the gasket are provided.

3. The electric compressor according to claim 2, wherein the gasket is made of rubber.

4. The electric compressor according to claim 2, wherein the gasket has a surging frequency equal to or higher than a frequency of a primary eigenvalue of the cover member.

5. The electric compressor according to claim 1, wherein the head is provided with a screw hole, and a screw is provided that penetrates through the cover member and through the first vibration isolation member from outside the cover member to be screwed into the screw hole.

6. The electric compressor according to claim 3, wherein the gasket has a surging frequency equal to or higher than a frequency of a primary eigenvalue of the cover member.

7. An electric compressor comprising:

a housing that accommodates a compressor and an electric motor that drives the compressor;

an inverter device including a circuit substrate on which an electronic component is mounted;

an accommodation casing including an accommodation portion body provided on a side surface of the housing to accommodate the inverter device, a substrate support portion that protrudes to an inside of the accommodation portion body to support one surface of the circuit substrate, and a cover member fixed to the accommodation portion body to close an opening of the accommodation portion body;

a bolt which is fastened to the substrate support portion to restrict a position of the circuit substrate with respect to the substrate support portion, and in which one surface of a head facing an inner surface of the cover member is flat; and a vibration isolation member that is disposed between the one surface of the head and the inner surface of the cover member and that has a surging frequency equal to or higher than a frequency of a primary eigenvalue of the cover member, wherein the compressor includes a fixed scroll and a movable scroll each having a spiral shape, a plurality of compression chambers that are formed between the fixed scroll and the movable scroll to compress a refrigerant by means of a movement of the movable scroll, and a discharge port that discharges the compressed refrigerant, when an average value of a length S1 (mm) of an inner curved line of the fixed scroll in a stage where the compressor discharges the refrigerant from the discharge port, the fixed scroll partitioning a compression chamber formed on an innermost side among the plurality of compression chambers, and of a length S2 (mm) of an outer curved line of the movable scroll that partitions the compression chamber formed on the innermost side is an average value $S_{AV}$ (mm), an eigenvalue E (kHz) of the cover member satisfies the following equation (1): $E \geq V/S_{AV}$ . . . (1) here, in the equation (1), V (m/s) is a sound speed of the refrigerant.

8. The electric compressor according to claim 7, wherein the head is provided with a screw hole, and a screw is provided that penetrates through the cover member and through the vibration isolation member from outside the cover member to be screwed into the screw hole.

9. The electric compressor according to claim 8, further comprising:

a gasket disposed on an outer surface of the cover member, wherein the screw is screwed into the screw hole via the gasket.

10. The electric compressor according to claim 9, wherein the gasket is made of rubber.

11. An electric compressor comprising:

a housing that accommodates a compressor and an electric motor that drives the compressor;

an inverter device including a circuit substrate on which an electronic component is mounted; and an accommodation casing including an accommodation portion body provided on a side surface of the housing to accommodate the inverter device, a substrate support portion that protrudes to an inside of the accommodation portion body to support one surface of the circuit substrate, and a cover member fixed to the accommodation portion body to close an opening of the accommodation portion body, wherein the cover member includes a through-hole at a portion facing the substrate support portion, and a grommet having a vibration isolation property that includes a ring-shaped groove accommodating the cover member located around the through-hole and that is mounted in the through-hole, and a screw that penetrates through the grommet from outside the cover member to be screwed to the substrate support portion are provided, wherein the compressor includes a fixed scroll and a movable scroll each having a spiral shape, a plurality of compression chambers that are formed between the fixed scroll and the movable scroll to compress a refrigerant by means of a movement of the movable scroll, and a discharge port that discharges the compressed refrigerant, when an average value of a length S1 (mm) of an inner curved line of the fixed scroll in a stage where the compressor discharges the refrigerant from the discharge port, the fixed scroll partitioning a compression chamber formed on an innermost side among the plurality of compression chambers, and of a length S2 (mm) of an outer curved line of the movable scroll that partitions the compression chamber formed on the innermost side is an average value $S_{AV}$ (mm), an eigenvalue E (kHz) of the cover member satisfies the following equation (1): $E \geq V/S_{AV}$ . . . (1) here, in the equation (1), V (m/s) is a sound speed of the refrigerant.

12. The electric compressor according to claim 11, wherein the grommet is bonded to the other surface of the circuit substrate and to the cover member.

13. The electric compressor according to claim 11, wherein the grommet has a surging frequency equal to or higher than a frequency of a primary eigenvalue of the cover member.

14. An electric compressor comprising:

a housing that accommodates a compressor and an electric motor that drives the compressor;

an inverter device including a circuit substrate on which an electronic component is mounted;

an accommodation casing including an accommodation portion body provided on a side surface of the housing to accommodate the inverter device, a substrate support portion that protrudes an inside of the accommodation portion body to support one surface of the circuit substrate, and a cover member fixed to the accommodation portion body to close an opening of the accommodation portion body; and a vibration isolation member that is in contact with an inner surface of the cover member, wherein the compressor includes a fixed scroll and a movable scroll each having a spiral shape, a plurality of compression chambers that are formed between the fixed scroll and the movable scroll to compress a refrigerant by means of a movement of the movable scroll, and a discharge port that discharges the compressed refrigerant, when an average value of a length $S_1$ (mm) of an inner curved line of the fixed scroll in a stage where the compressor discharges the refrigerant from the discharge port, the fixed scroll partitioning a compression chamber formed on an innermost side among the plurality of compression chambers, and of a length $S_2$ (mm) of an outer curved line of the movable scroll that partitions the compression chamber formed on the innermost side is an average value $S_{AV}$ (mm), an eigenvalue E (kHz) of the cover member satisfies the following equation (2):

$$E \geq V/S_{AV} \quad (2)$$

here, in the equation (2), V (m/s) is a sound speed of the refrigerant.

15. The electric compressor according to claim 14, further comprising a bolt which is fastened to the substrate support portion to restrict a position of the circuit substrate with respect to the substrate support portion, and in which one surface of a head facing an inner surface of the cover member is flat, wherein the vibration isolation member is disposed between the one surface of the head of the bolt and the inner surface of the cover member, and is bonded to the one surface of the head and to the inner surface of the cover member.

16. The electric compressor according to claim 14, further comprising a bolt which is fastened to the substrate support portion to restrict a position of the circuit substrate with respect to the substrate support portion, and in which one surface of a head facing an inner surface of the cover member is flat, wherein the vibration isolation member is disposed between the one surface of the head of the bolt and the inner surface of the cover member, and has a surging frequency equal to or higher than a frequency of a primary eigenvalue of the cover member.

* * * * *